US011684181B1

(12) United States Patent
Eastman et al.

(10) Patent No.: US 11,684,181 B1
(45) Date of Patent: Jun. 27, 2023

(54) SPORTS EQUIPMENT RACK AND METHOD OF USE

(71) Applicants: Matthew Eastman, Havertown, PA (US); Lee Elias, Havertown, PA (US)

(72) Inventors: Matthew Eastman, Havertown, PA (US); Lee Elias, Havertown, PA (US)

( * ) Notice: Subject to any disclaimer, the term of this patent is extended or adjusted under 35 U.S.C. 154(b) by 0 days.

(21) Appl. No.: 17/381,014

(22) Filed: Jul. 20, 2021

(51) Int. Cl.

| | |
|---|---|
| ***A47F 5/04*** | (2006.01) |
| ***A47F 5/10*** | (2006.01) |
| ***D06F 57/00*** | (2006.01) |
| ***A47F 5/06*** | (2006.01) |
| ***A47F 7/19*** | (2006.01) |
| ***A47G 25/06*** | (2006.01) |
| ***A63B 71/00*** | (2006.01) |

(52) U.S. Cl.
CPC ..... *A47F 5/04* (2013.01); *A47F 5/06* (2013.01); *A47F 5/10* (2013.01); *A47F 5/106* (2013.01); *A47F 7/19* (2013.01); *A47G 25/0664* (2013.01); *A47G 25/0671* (2013.01); *A63B 71/0036* (2013.01); *D06F 57/00* (2013.01)

(58) Field of Classification Search
CPC ..... A47F 5/04; A47F 5/10; A47F 7/10; A47F 7/08; A47F 7/19; A47F 7/24; A47F 8/00; A47F 5/06; A47F 5/106; A63B 71/0036; D06F 57/00; D06F 57/04; A47B 81/00; A47B 61/003; A47G 25/0664; A47G 25/0671
USPC ..... 211/85.7, 85.3, 196, 197, 205, 85.24; D21/727; 473/560; D6/552, 563, 569, D6/320, 316, 324, 327, 328
See application file for complete search history.

(56) References Cited

U.S. PATENT DOCUMENTS

| | | | | | |
|---|---|---|---|---|---|
| 279,810 | A * | 6/1883 | Richards, Sr. | F16M 11/10 | 248/302 |
| 335,774 | A * | 2/1886 | Richardson | F16M 11/20 | 211/196 |
| 459,583 | A * | 9/1891 | Johnson | A22C 15/003 | 211/196 |
| 504,053 | A * | 8/1893 | Schermerhorn | A47F 7/10 | 211/172 |
| 863,820 | A * | 8/1907 | Wingert | A47G 25/0671 | 223/90 |
| 1,188,921 | A * | 6/1916 | Finkelstein | A47G 25/0671 | 211/1 |
| 1,292,931 | A * | 1/1919 | Van Etten | A47G 25/0664 | 211/196 |
| 1,358,756 | A * | 11/1920 | Kozlowski | A47G 25/0664 | 211/163 |
| 2,631,802 | A * | 3/1953 | Tunis | A47F 5/06 | 248/435 |
| 3,021,960 | A * | 2/1962 | Pipe | A47G 25/0664 | 248/188.7 |

(Continued)

*Primary Examiner* — Jennifer E. Novosad
(74) *Attorney, Agent, or Firm* — Leavitt Eldredge Law Firm

(57) ABSTRACT

A sports equipment rack for convenient storage, transportation, and drying of sports equipment. The sports equipment rack includes a vertical shaft configured to substantially resemble a hockey stick, the vertical shaft having a top portion and a bottom portion. The sports equipment rack also includes one or more sets of opposing horizontal members, the opposing horizontal members having a first end and an opposing end; one or more fastening attachments in communication with the opposing end; and a plurality of openings.

2 Claims, 4 Drawing Sheets

(56) References Cited

U.S. PATENT DOCUMENTS 3,771,665 A * 11/1973 Potter ..... A47F 5/06 211/208
3,923,277 A * 12/1975 Perrault ..... F16L 3/00 211/208
D243,804 S * 3/1977 Underwood ..... D6/674
D325,474 S * 4/1992 Jackson ..... D6/563
5,170,898 A * 12/1992 Katz ..... A47G 25/0664 248/245
D339,249 S * 9/1993 Wu ..... D6/681.1
D362,755 S * 10/1995 Ehrmann ..... D6/563
D380,027 S * 6/1997 Ferguson ..... D6/552
D385,127 S * 10/1997 Affleck ..... D6/674
D398,469 S * 9/1998 Leong ..... D6/552
5,848,716 A * 12/1998 Waranius ..... A63B 60/60 211/205
6,073,783 A * 6/2000 Allman ..... D06F 59/02 211/85.3
6,216,887 B1 * 4/2001 Soo ..... A47G 25/0671 211/205
6,311,857 B1 * 11/2001 Al-Darraji ..... A47G 25/0664 248/431
D458,069 S * 6/2002 Shiflet ..... D21/759
D458,496 S * 6/2002 Shiflet ..... D6/552
D482,883 S * 12/2003 Lenardi ..... D6/358
D488,883 S * 4/2004 Davis ..... D26/94
6,959,824 B1 * 11/2005 Alperson ..... A47F 5/137 211/1.3
6,983,853 B1 * 1/2006 Fickett ..... A47F 7/00 248/303
7,025,215 B2 * 4/2006 Bain ..... A47G 25/16 248/150
D535,512 S * 1/2007 Eastman ..... D6/552
7,165,689 B2 * 1/2007 McDaniel ..... A47F 7/24 211/116
D536,902 S * 2/2007 Wu ..... D6/680.2
D538,570 S * 3/2007 Tate ..... D6/552
D558,844 S * 1/2008 Jeanneau ..... D21/727
7,422,122 B2 * 9/2008 Holland ..... A63B 71/0045 211/196
8,016,137 B2 * 9/2011 Shaha ..... A47F 5/103 248/200
D675,033 S * 1/2013 Sutton ..... D6/316
8,393,482 B2 * 3/2013 Durham ..... D06F 59/02 248/163.1
8,418,860 B2 * 4/2013 Rimmer ..... D06F 57/04 211/85.3
8,567,734 B2 * 10/2013 McCoy ..... F16L 3/223 211/186
D721,612 S * 1/2015 Colman ..... D11/133
8,966,781 B1 * 3/2015 McKernan ..... A61L 2/07 422/292
9,402,471 B1 * 8/2016 Gonzalez Ruiz ..... A47F 7/08
9,518,696 B1 * 12/2016 Lin ..... A47B 96/061
9,909,250 B1 * 3/2018 Greenspon ..... A47G 25/0685
10,333,320 B2 * 6/2019 Salinas Ruiz ..... H02J 50/10
2007/0175848 A1 * 8/2007 Mallen ..... A47G 25/0671 211/205
2011/0036794 A1 * 2/2011 Schott ..... A62C 99/00 211/85.3
2015/0233639 A1 * 8/2015 Mustari ..... A47F 5/06 211/172
2016/0135594 A1 * 5/2016 Anderson ..... A47B 81/00 211/20
2019/0070472 A1 * 3/2019 Duran ..... A47F 5/04
2019/0105550 A1 * 4/2019 Teasdale ..... A63B 71/0036
2019/0246824 A1 * 8/2019 Cohn ..... A47G 25/0685

* cited by examiner

SPORTS EQUIPMENT RACK AND METHOD OF USE

BACKGROUND

1. Field of the Invention

The present invention relates generally to sports equipment, and more specifically to a sports equipment rack that is formed of a hockey stick structure to provide for convenient storage, transportation, and drying of sports equipment.

2. Description of Related Art

Many sports require a variety of sports equipment (e.g., balls, shoes, gloves, racquets, protective equipment, etc.) to participate. Various storage devices have been developed for storing and organizing sports equipment.

One of the problems commonly associated with current storage devices is their lack of versatility. For example, because sports are often played and practiced in different locations, players are required to carry and transport their sports equipment in a vehicle. However, many storage devices are large and heavy, making it difficult for players to load and unload into vehicles. In addition, certain sports require particular equipment such as shoes and gloves to be dried and current storage devices are not suitable for drying these items.

Hence, it is desirable and advantageous to have a sports equipment rack that improves the storage, transportation, and drying of sports equipment, thereby providing for enhanced user convenience.

Accordingly, although great strides have been made in the area of storage devices for sports equipment, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
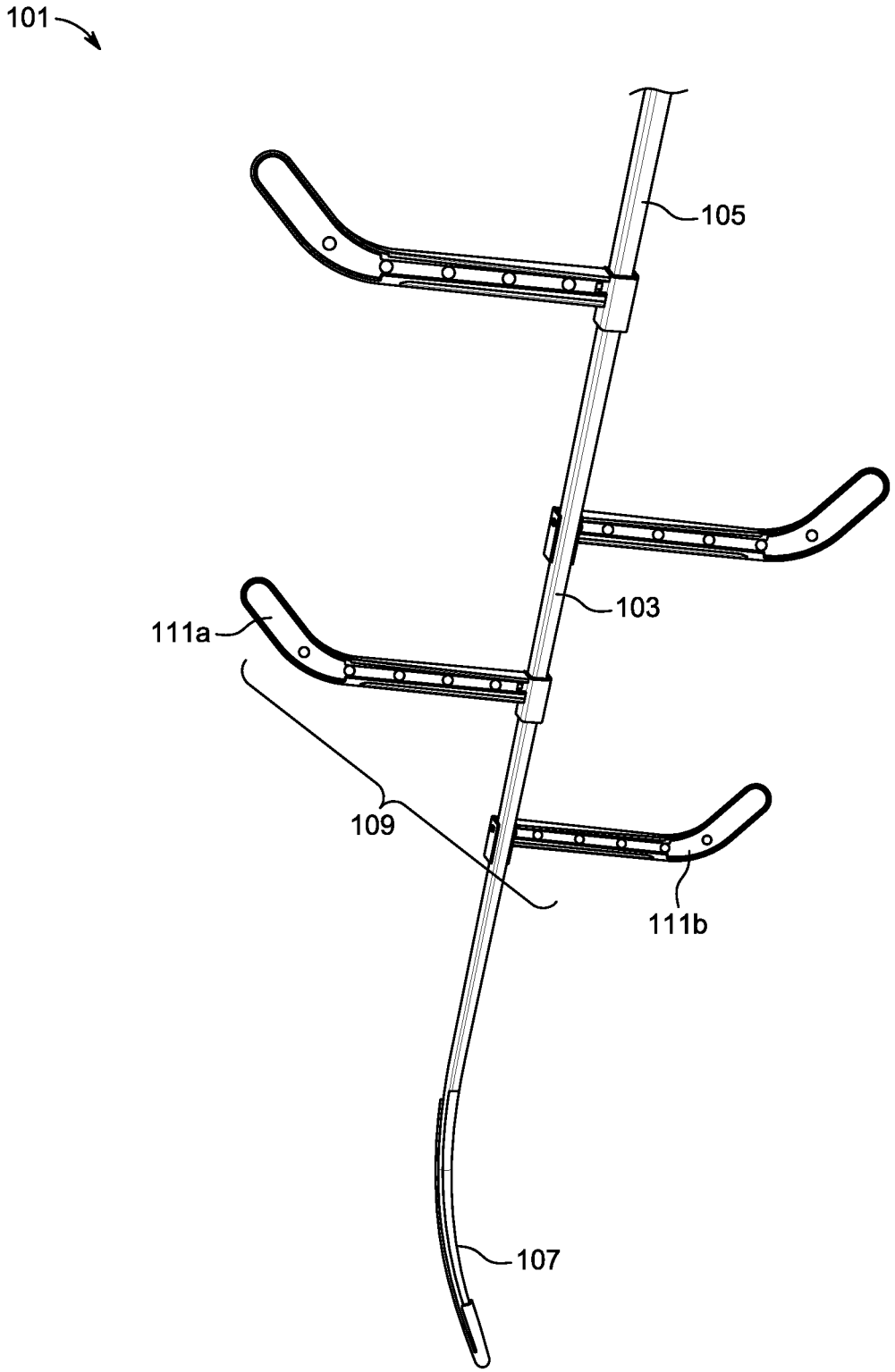
FIG. 1. is a front view of a sports equipment rack in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional storage devices for sporting equipment. Specifically, the present invention provides a means for a player to store and dry his or her sports equipment during travel. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a front view of a sports equipment rack 101 in accordance with a preferred embodiment of the present application. It will be appreciated that the sports equipment rack 101 overcomes one or more of the above-listed problems commonly associated with conventional storage devices for sporting equipment.

In the contemplated embodiment, the sports equipment rack 101 is configured to support at least one piece of sports equipment. Examples of sports equipment include, without limitation, helmets, pads, gloves, shoes, jerseys, uniforms, and the like. It should be appreciated that the sports equipment rack 101 may vary based on aesthetical, functional, or manufacturing considerations.

The sports equipment rack 101 includes a vertical shaft 103 having a top portion 105 and a bottom portion 107. It should be appreciated that the shape of the vertical shaft 103 substantially resembles a hockey stick, with the top portion 105 substantially resembling the handle of the hockey stick and the bottom portion 107 substantially resembling the blade of the hockey stick.

The sports equipment rack 101 also includes a one or more sets of opposing horizontal members 109 coupled to the vertical shaft 103. It should be appreciated that the shape of the opposing horizontal members, for instance horizontal members 111*a*, 111*b*, substantially resembles the blade of a hockey stick.

Figure 2:
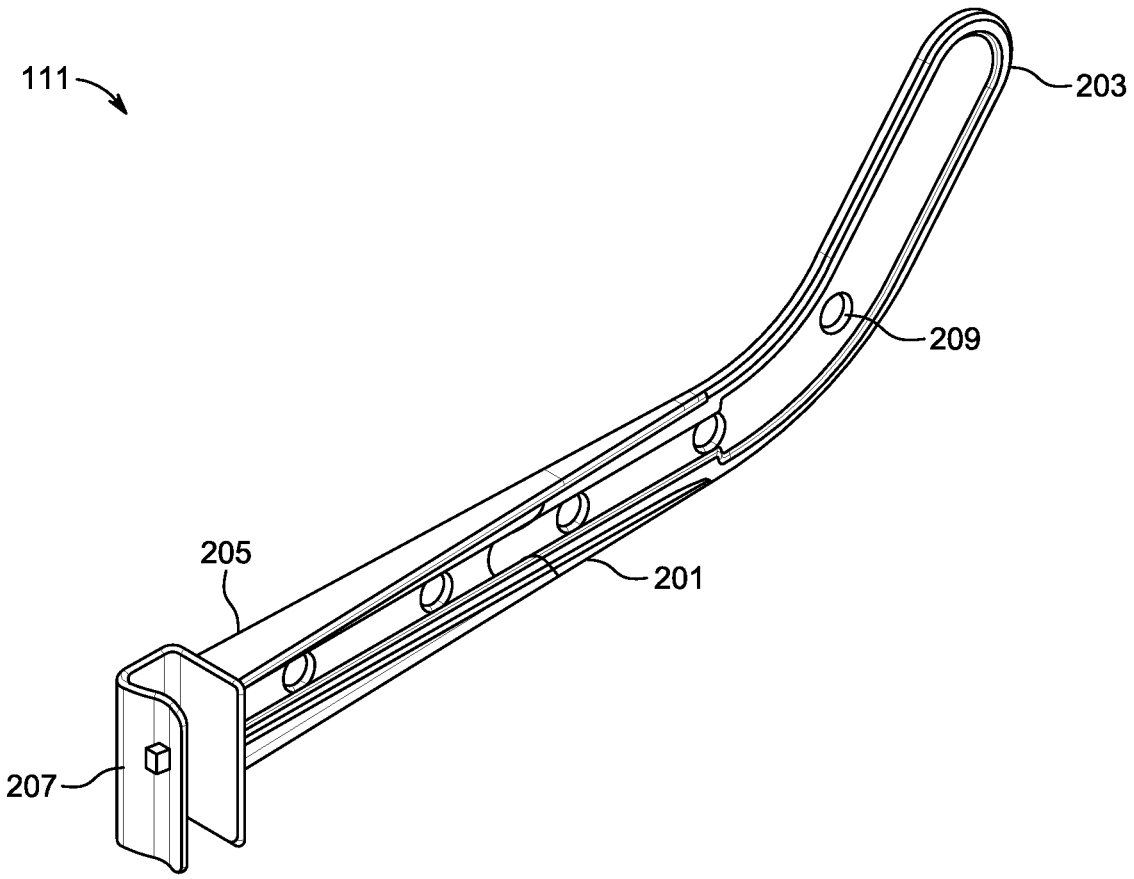
FIG. 2 is an enlarged perspective view of the horizontal member of FIG. 1.

In FIG. 2, an enlarged perspective view of the horizontal member 111 is illustrated. As shown, the horizontal member 111 includes an elongated member 201 having a first end 203 and an opposing end 205, one or more fastening attachments 207, and a plurality of openings 209.

The first end 203 is configured with an upward curve to substantially resemble the blade of a hockey stick. The opposing end 205 is in communication with the attachment mechanism 207.

The one or more fastening attachments 207 are configured to secure the horizontal member 111 to the vertical shaft 103. It should be appreciated that the one or more fastening attachments 207 may be any type of fastener desirable or suitable to secure the horizontal member 111 to the vertical shaft 103 including, without limitation, screws, bolts, clamps, clips, or the like.

The plurality of openings 209 is configured to allow the insertion of one or more hanger therethrough. It should be appreciated that the plurality of openings 209 may be in any configuration suitable to achieve a desired aesthetic including, without limitation, circular, oval, triangular, square, star-shaped, heart-shaped, character-shaped, and the like.

It should also be appreciated that one of the unique features believed characteristic of the present application is that the one or more sets of horizontal members 109 balance the weight of sports equipment placed thereon and prevent the vertical shaft 103 from twisting.

Figure 3:
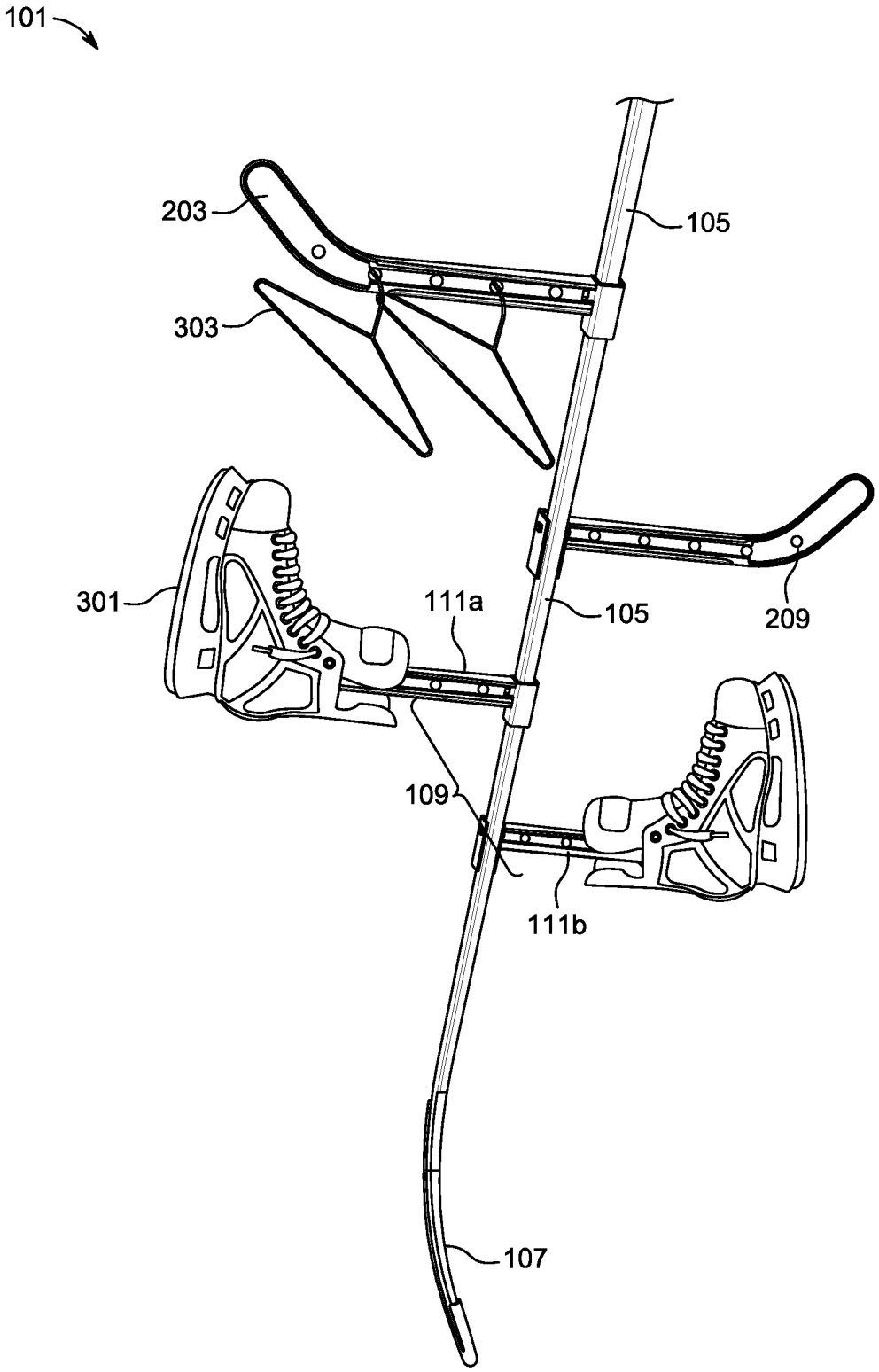
FIG. 3 is a front view of the sports equipment rack of FIG. 1 having various sports equipment placed thereon.

In FIG. 3, a front view of the sports equipment rack 101 having various sports equipment placed thereon is depicted. As shown, a pair of hockey skates 301 may be hung on the set of horizontal members 109. In addition, one or more hangers 303 may be inserted into the plurality of openings 209 such that sports equipment such as jerseys, uniforms, or the like may be placed thereon.

Figure 4:
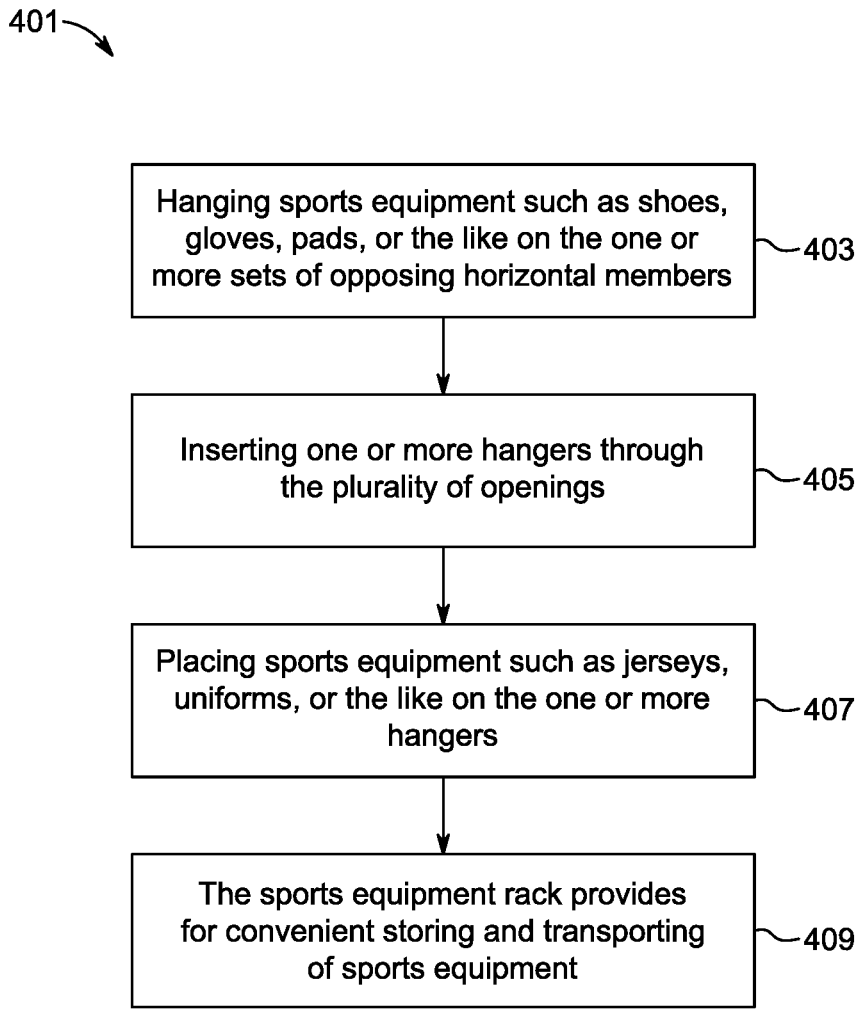
FIG. 4 is a flowchart of a method of use of the sports equipment rack of FIG. 1.

In FIG. 4, a flowchart 401 depicts a simplified method of use associated with the sports equipment rack 101. During use, the user may hang sports equipment such as shoes, gloves, pads or the like on the one or more sets of opposing horizontal members, as shown with box 403. The user may also insert one or more hangers through the plurality of openings so that he or she can place sports equipment such as jerseys, uniforms, or the like on the one or more hangers, as shown with boxes 405, 407. The sports equipment rack provides for convenient storing and transporting of sports equipment, as shown with box 409.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A sports equipment rack for convenient storage, transportation, and drying of at least one piece of sports equipment, comprising:
- a vertical shaft shaped as a hockey stick, the vertical shaft formed integrally as one piece and having:
  - a top portion configured to substantially resemble a handle of the hockey stick, the top portion has an elongated straight directional shape;
  - a bottom portion that resembles a blade of the hockey stick; and
- one or more sets of opposing horizontal members, the opposing horizontal members having:
  - an elongated member having a first end and an opposing end that removably secures to the vertical shaft, the elongated member extending in a first direction relative to the vertical shaft;
  - one or more fastening attachments in communication with the opposing end, the one or more fastening attachments forming a C-shaped clip configured to removably engage with the top portion of the vertical shaft; and
  - a plurality of openings extending through a thickness of the elongated member and configured to allow the insertion of one or more hangers therethrough;
  - a second elongated member resembling the elongated member and positioned in a section direction opposing the first direction;
  - wherein the first end is configured to substantially resemble a blade of a hockey stick, the first end extends in a direction relative to the bottom portion;
  - wherein the one or more sets of opposing horizontal members securely couple to the vertical shaft via the one or more fastening attachments.

2. A method of storing, transporting, and drying at least one piece of sports equipment, the method comprising:
- providing the system of claim 1;
- inserting one or more hangers into the plurality of openings;
- hanging at least one piece of sports equipment on the one or more sets of opposing horizontal members; and
- placing at least one piece of sports equipment on the one or more hangers.

* * * * *